United States Patent [19]

McAllister

[11] 4,190,990

[45] Mar. 4, 1980

[54] FRAME ASSEMBLY

[76] Inventor: Jack G. McAllister, 2701 N. Douglas Dr., Minneapolis, Minn. 55422

[21] Appl. No.: 857,435

[22] Filed: Dec. 5, 1977

Related U.S. Application Data

[60] Continuation of Ser. No. 712,351, Aug. 6, 1976, abandoned, which is a division of Ser. No. 255,688, May 22, 1972, Pat. No. 3,973,370.

[51] Int. Cl.[2] ..... E04B 1/32

[52] U.S. Cl. ..... 52/66; 52/81; 52/86

[58] Field of Search ..... 52/80, 81, 86, 66, 109, 52/745, 108

[56] References Cited

U.S. PATENT DOCUMENTS

| | | | |
|---|---|---|---|
| 1,112,542 | 10/1914 | Loser | 52/640 |
| 2,353,071 | 7/1944 | Pitou | 52/640 |
| 2,713,774 | 7/1955 | Heintzmann | 61/45 |
| 2,903,856 | 9/1959 | En Dean | 52/115 |
| 3,053,351 | 9/1962 | Fulcher | 52/109 |
| 3,126,708 | 3/1964 | Jasper | 61/45 |
| 3,273,574 | 9/1966 | Huddle | 52/63 |
| 3,357,142 | 12/1967 | Furrer | 52/2 |
| 3,375,624 | 4/1968 | Mikulin | 52/109 |
| 3,381,923 | 5/1968 | Berry | 52/109 |
| 3,495,866 | 2/1970 | Bontrager | 52/66 |
| 3,530,622 | 5/1968 | Cohen | 52/86 |
| 3,559,353 | 2/1971 | Partridge | 52/109 |
| 3,594,973 | 7/1971 | Archer | 52/741 |
| 3,710,806 | 1/1973 | Kelly | 52/109 |

FOREIGN PATENT DOCUMENTS

| | | | |
|---|---|---|---|
| 550231 | 10/1956 | Italy | 52/640 |

OTHER PUBLICATIONS

Examiner's Color Coded Drawing from Figure 1 of Kelly.

*Primary Examiner*—James A. Leppink
*Assistant Examiner*—Henry E. Raduazo
*Attorney, Agent, or Firm*—Burd, Bartz & Gutenkauf

[57] ABSTRACT

A frame assembly covering an area having expandable struts secured at their ends to connectors. Outer struts are attached to fixed anchors located at the perimeter of the area. The struts have separate members that are moved relative to each other in response to a force, as fluid under pressure or springs, to increase the length of the struts. Contracted struts and connectors are put together on the surface of the area forming a network of struts and connectors. The network may be arranged in regualr geometric patterns. The frame assembly is erected by expanding the struts to raise the network of struts and connectors from the surface of the area. The expanded struts are locked to hold the frame assembly in its erected position.

24 Claims, 12 Drawing Figures

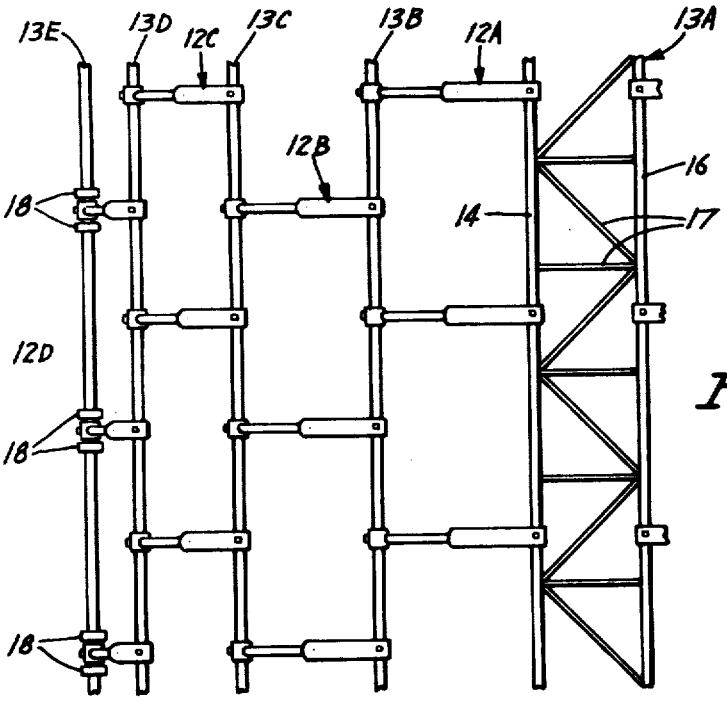
FIG. 4
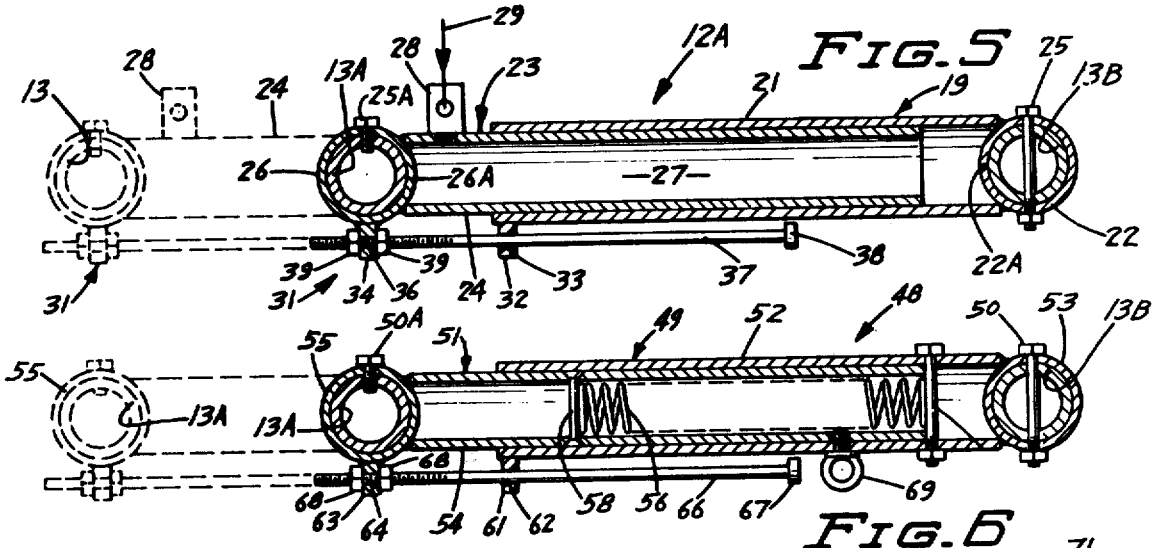
FIG. 5
FIG. 6
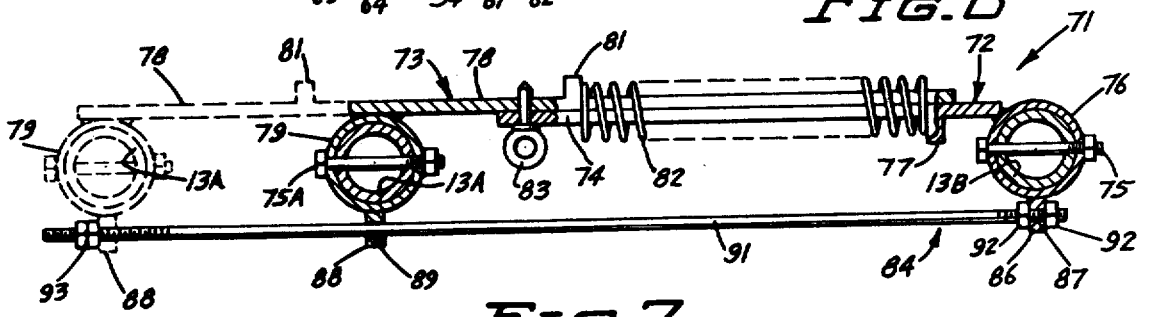
FIG. 7

FRAME ASSEMBLY

This application is a continuation of U.S. application Ser. No. 712,351, filed Aug. 6, 1976, now abandoned. Application Ser. No. 712,351 is a division of U.S. application Ser. No. 255,688, filed May 22, 1972, now U.S. Pat. No. 3,973,370.

BACKGROUND OF THE INVENTION

Frame assemblies are used to support covering members, as roofs, floors and the like. A conventional frame assembly is assembled piece-by-piece, or in sections, before the covering structure is placed on the frame assembly. In the construction of the frame assembly, upright center supports or temporary scaffolding is necessary to hold the workers and materials. This building procedure requires considerable time and a number of skilled workers. Furthermore, the temporary scaffolding or lift structures must be removed after the frame assembly has been completed.

A geodesic dome has a frame assembly supporting covering panels. The normal procedure in erecting a geodesic dome is to add the panels around the periphery of an initial center section. This center assembly is progressively lifted while additional panels are attached around the periphery by men working at the ground level until all the panels are in place. A center tower rigged with lifting cables and winches is used to lift the geodesic structure progressively. This method requires tower footings to support the entire weight of the dome. These footings are not used after the dome is in place.

Holcombe in U.S. Pat. No. 3,106,772 discloses a method of utilizing pneumatic bags to function as lifting means and temporary scaffolding in the erection of a dome structure. McCracken in U.S. Pat. No. 3,557,515 utilizes air pressure to raise a flexible roof structure which is made rigid after it is in its raised position, thereby forming a self-standing roof structure. McAllister in U.S. Pat. No. 3,676,976, describes a method of making a convex structure, as a roof, utilizing a fluid impervious means in combination with cooperating structural means. The structure is set up in ground level position and then raised to a convex curved shape by subjecting the fluid impervious means to fluid under pressure. The curved configuration of the structure is maintained by the cooperating structural means after the fluid has been exhausted from under the fluid impervious means.

SUMMARY OF THE INVENTION

The invention relates to a frame assembly. The frame assembly has struts secured to connectors forming a network of struts and connectors convering an area. The struts each have a first member and a second member which are movable relative to each other to expand the struts in a longitudinal direction. Holding means cooperates with the first member and second member to fix the expanded position of the strut. When the struts have been expanded, the first and second members of each strut can be locked together to provide a rigid strut.

It is an object of the invention to provide a a frame assembly, such as roof framing members, that can be erected in a minimum of time, with a minimum of materials, and with a minimum of labor. Another object of the invention is to provide a frame assembly that is set up in a generally horizontal position and is subjected to forces to self raise to an elevated or erected positon. IN THE DRAWINGS FIG. 1 is a fragmentary portion of a top plan view of the frame assembly of the invention in its initial or ground position;

FIG. 4 is a top plan view taken along line 4—4 of FIG. 3 looking in the direction of the arrows;

FIG. 5 is a longitudinal sectional view of one longitudinal extendible strut means of the frame assembly of FIG. 1;

FIG. 6 is a view similar to FIG. 5 of a modification of a longitudinal extendible strut means usable in the frame assembly of the invention;

FIG. 7 is a view similar to FIG. 5 of another modification of a longitudinal extendible strut means usable in the frame assembly of the invention;

Figure 1:
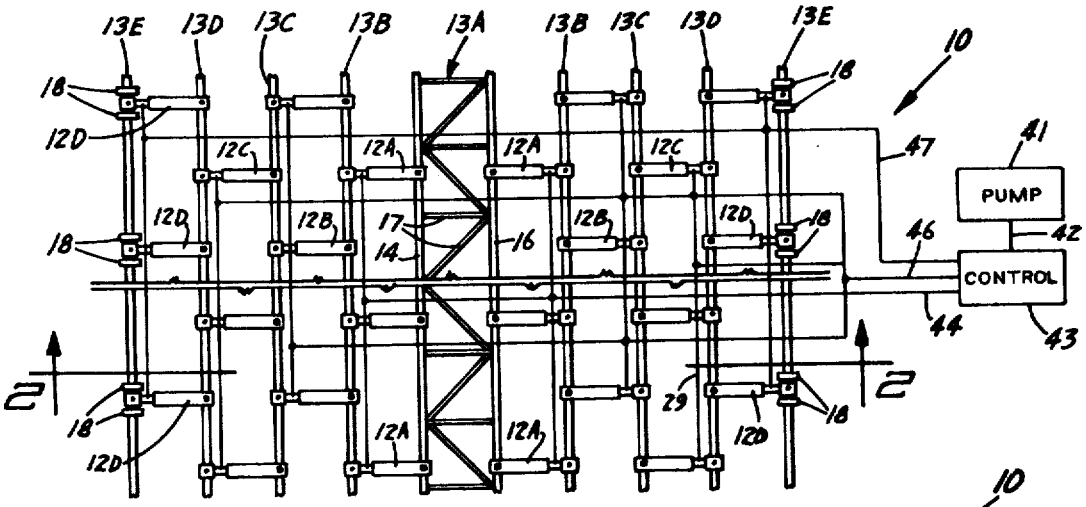
Figure 2:
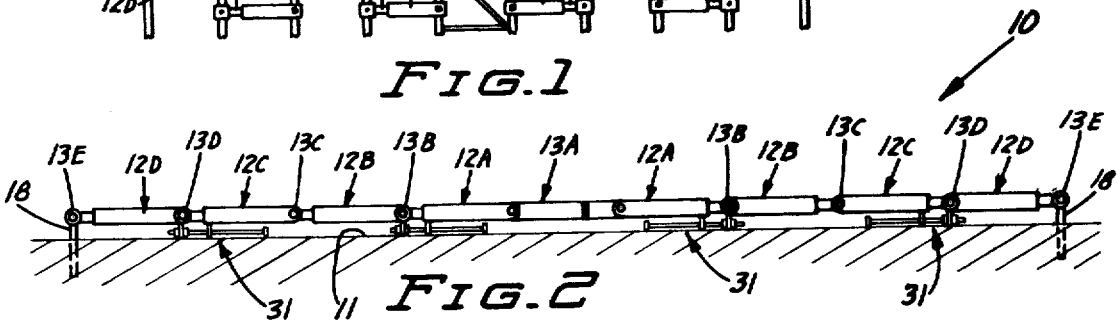
FIG. 2 is an enlarged sectional view taken along line 2—2 of FIG. 1.

Referring to the drawings, there is shown in FIGS. 1 to 4, a frame assembly indicated generally at 10 covering a surface 11 of an area of the ground, or a surface bordered by a foundation or the like. Surface 11 is a plane surface. Frame assembly 10 has a plurality of extendible members or struts 12A, 12B, 12C and 12D arranged in generally parallel alignment. Connectors or rigid members 13A, 13B, 13C, 13D and 13E are operably coupled to the extendible struts 12A through 12D to form a generally rectangular network or pattern of struts and connectors covering the surface 11. Connectors 13A through 13E are rigid, elongated runners or rods. The adjacent connectors are located in generally parallel relationship with each other and are fixed or non-rotatably joined to the ends of the extendible struts. The center connector 13A is of a rigid frame construction comprising a pair of elongated side members or rods 14 and 16. Cross bracing 17 secured to rods 14 and 16 holds the rods in spaced relationship. Connector 13A can be replaced with a single rigid rod connector. The outer or side connectors 13E are located at the outside edges of the surface 11 and are pivotally connected to anchors 18. Connectors 13B, 13C and 13D are positioned between center connector 13A and outside connector 13E, as shown in FIG. 1. The struts are located in longitudinal rows between the connectors. Struts 12A are secured to connectors 13A and 13B. Struts 12B are secured to connectors 13B and 13C. Struts 12C are secured to connectors 13C and 13D. Anchored or outside struts 12D are pivotally connected to connectors 13D and 13E. Outside struts 12D can be rigid members or links having a fixed length. These members can be pivotally connected to anchors or a foundation along the sides of the surface 11.

The outside extendible struts 12D are pivotally connected to anchors 18 secured to the surface 11. Anchor means 18 are a plurality of members that extend downwardly into the surface 11 forming a fixed holding means for the frame assembly 10. The upper ends of anchor means 18 project upwardly from surface 11 and have holes for pivotally accommodating the outer connectors 13E. Connectors 13E are elongated members such as rods or tubes which extend through the openings in the anchor means 18 and are pivotally joined to the outer extendible struts 12D. As shown in FIG. 1, pairs of anchor means 18 are located on opposite sides of the outer portion of the extendible struts 12D to provide hinge connections between the anchor means 18 and the extendible struts 12D. The portions of the connector members 13A between adjacent pairs of anchoring means can be removed. Alternatively, the struts 12D can be connected directly to the anchors 18. The anchor means can be part of a foundation along the sides of the surface 11.

Referring to FIG. 5. there is shown the details of extendible strut 12A connected to spaced connectors 13A and 13B. Struts 12B-D are identical. The following description is limited to strut 12A.

Strut 12A is shown in FIG. 5 in full lines in its contracted position and in broken lines in its extended position. Strut 12A has a first member indicated generally at 19 cooperating with a second member indicated at 23 to provide a longitudinally extendible strut. The first member 19 has an elongated cylinder or sleeve 21 connected to a transverse collar or ring 22. Collar 22 has a portion 22A that closes the end of cylinder 21. The collar 22 is positioned around and fixed to the connector member 13B with a bolt 25. The second member 23 has an elongated cylinder or sleeve 24 telescopically mounted within cylinder 21. The outer end of cylinder 24 is attached to a transverse collar or ring 26. Collar 26 has a portion 26A that closes the outer end of cylinder 24. Collar 26 is positioned around and fixed to connector member 13A with bolt 25A. Other structures, as welds, keys, and the like, can be used to attach the ends of the struts to the connectors.

The cylinders 21 and 24 have a common chamber 27 for receiving a fluid, as air or water, under pressure whereby the cylinders 21 and 24 move outwardly relative to each other to form a piston and cylinder arrangement to expand or elongate the member 12A. The fluid is introduced into chamber 27 through a coupling 28 attached to cylinder 24 and a fluid carrying line 29.

The extent of elongation of the cylinders 21 and 24 relative to each other is controlled with a limit stop indicated generally at 31. Stop 31 comprises a first tab 32 secured to cylinder 21. Tab 32 has a longitudinal hole 33. A second tab 34 is secured to collar 26. Tab 34 has a hole 36 in general longitudinal alignment with hole 33. An elongated rod 37 slideably extends through hole 33 and is connected to tab 34. Rod 37 has a head 38 engageable with tab 32 to limit the maximum open or expanded position of cylinders 21 and 24. The opposite end of rod 37 carries nuts 39 which adjustably secure the rod to the tab 34. Nuts 39 are adjustable whereby the length of rod 37 cooperating with tab 32 can be adjusted, thereby adjusting the expanded length of the strut. Other types of stop structures can be used to limit the expansion of the struts. The stop structure can be located within the struts.

Returning to FIG. 1, the fluid under pressure is supplied to the extendible struts 12A-D by a pump 41. Pump 41 is connected by line 42 to a control 43, such as an array of valves. A first line 44 couples the control 43 with the extendible strut 12A connected to connector 13A. A second line 46 is connected to the intermediate rows of extendible struts 12B and C. A third line 47 is connected to the outermost rows of extendible struts 12D. Control 43 is operable to selectively or simultaneously direct fluid under pressure to the struts 12A-D.

Referring to FIG. 6, there is shown a mechanically biased extendible member or strut indicated generally at 48 that can be used in the frame assembly 10. Strut 48 has a first member 49 and a second member 51 movably arranged relative to each other to provide an expandable and extendible strut for the frame assembly. The first member 49 has a cylinder or sleeve 52 secured to a transverse collar or ring 53. The ring is positioned around and fixed to the connector member 13B with bolt 50. The second member 51 has an elongated cylinder or sleeve 54 secured to an end collar or ring 55. Ring 55 is positioned around and fixed to connector member 13A with bolt 50A. Located within cylinder 54 is an elongated expandable coil spring 56. One end of spring 56 abuts against a transverse bolt 57 mounted on the cylinder 52. The opposite end of spring 56 abuts against a transverse pin 58 mounted on the cylinder 54. The spring 56 is held in a compressive state between the pins 57 and 58 whereby the strut 48 is preloaded. A holding pin 69 extended through holes in the cylinders 52 and 54 maintains the strut in the preloaded condition.

The strut 48 has stop means for limiting its elongation indicated generally at 59. Stop means 59 is similar in construction to stop 31 shown in FIG. 5. Stop means 59 has a first tab 61 secured to cylinder 52 having a hole 62. A second tab 63 secured to collar 55 has a hole 64. A rod 66 is located in holes 62 and 64. Rod 66 has a head 67 engageable with tab 62 to limit the outward relative movement of cylinders 52 and 54. Nuts 68 threaded on rod 66 engage opposite sides of the tab 63 to adjustably position the rod relative to tab 63.

In use, the expansion of strut 48 is achieved by removal of holding pin 69. This permits the spring 56 to expand, thereby forcing the adjacent connector members 13A and 13B away from each other.

Referring to FIG. 7, there is shown a further modification of the extendible member or strut indicated generally at 71. Strut 71 has a first member 72 movably associated with a second member 73 providing an expandable strut between adjacent connector members 13A and 13B. The first member 72 has an elongated bar 74 secured at one end to a transverse collar or ring 76. Collar 76 surrounds connector member 13B and is secured thereto with bolt 75. Extended downwardly from the bottom of member 72 adjacent collar 76 is a short shoulder or lug 77. Second member 73 is an elongated bar 78 positioned in alignment with and over the bar 74. The outer end of bar 78 is secured to transverse collar or ring 79 mounted on the connector 13A. Bolt 75A attaches ring 79 to connector 13A. Bar 78 has an upwardly directed shoulder or lug 81 providing a stop for one end of a coil spring 82. The opposite end of spring 82 bears against lug 77 on the bar 74. Spring 82 is in a compressive state between the lug 77 and lug 81. A pin 83 extended through holes in bars 74 and 78 maintains the plates in a fixed position relative to each other and the spring in a compressive state. Spring 82 surrounds the bars 74 and 78 thereby holding the bars adjacent each other.

In use, pin 83 is removed so that the expansion force of spring 82 will move the bars relative to each other. The movement caused by spring 82 is limited by a stop means indicated generally at 84. Stop means 84 has a first tab 86 secured to collar 76. Tab 86 has a hole 87 for accommodating a portion of rod 91. A second tab 88 is secured to collar 79. Tab 88 has a hole 89 for slideably accommodating rod 91. A pair of nuts 92 located on opposite sides of tab 86 are threaded on rod 91 to secure the rod to the tab. The opposite end of rod 91 carries a pair of nuts 93 forming limit abutments which are engageable with tab 88 to limit the elongation or expansion of strut 71.

The process of making and erecting the frame assembly 10 is shown in FIGS. 1 to 4. The size of the frame assembly is determined by measuring and laying out the area to be covered by the assembly. The anchors 18 are placed in a foundation or other secure structure around the outer perimeter of the area or surface 11 to be covered by frame assembly 10. Extendible struts 12A–D and connectors 13A–E are arranged in generally rectangular pattern, as shown in FIG. 1, on the surface 11. The outer connectors 13E are pivotally attached to the anchors 18 and to the outer ends of struts 12D. The network or pattern of struts and connectors is completed by attaching the struts 12A–D to connectors 13A–E with bolts 25 and 25A. The inner struts 12A have ends or collars 26 connected to the central connector 13A. The entire framework is assembled in a flat condition on surface 11, as the ground, with the struts 12A–D in their contracted positions. The pump 41 is operable to supply fluid under pressure to control 43. Control 43 is used to selectively direct the fluid under pressure to progressively expand the rows of extendible struts 12A–D. The center connector 13A is initially raised by expanding the struts 12A connected thereto. The fluid is supplied to these struts 12A via line 44 to expand the struts.

As the frame assembly is elevated, the connectors are subjected to twisting or torsion forces. These torsion forces act against the force of the air pressure thereby keeping the frame assembly in its pattern and controlling the curvature of the erected frame assembly. The struts 12A–D are also subjected to bending forces. They flex to a convex curved shape as the frame assembly is being erected. The control is then operated to provide fluid under pressure to line 46 while maintaining the fluid under pressure in line 44. The fluid under pressure in line 46 will expand the second and third rows of struts 12B and 12C whereby the mid-portion of the framework is elevated. The final erection of the framework is achieved by applying fluid under pressure to line 47 to expand the end struts 12D. The fluid under pressure will hold all of the struts 12A–D in an arcuate position against the biasing forces of the connectors 13A–D and struts 12A–D, as shown in FIG. 3 to enclose a space 94 over the surface 11.

Figure 3:
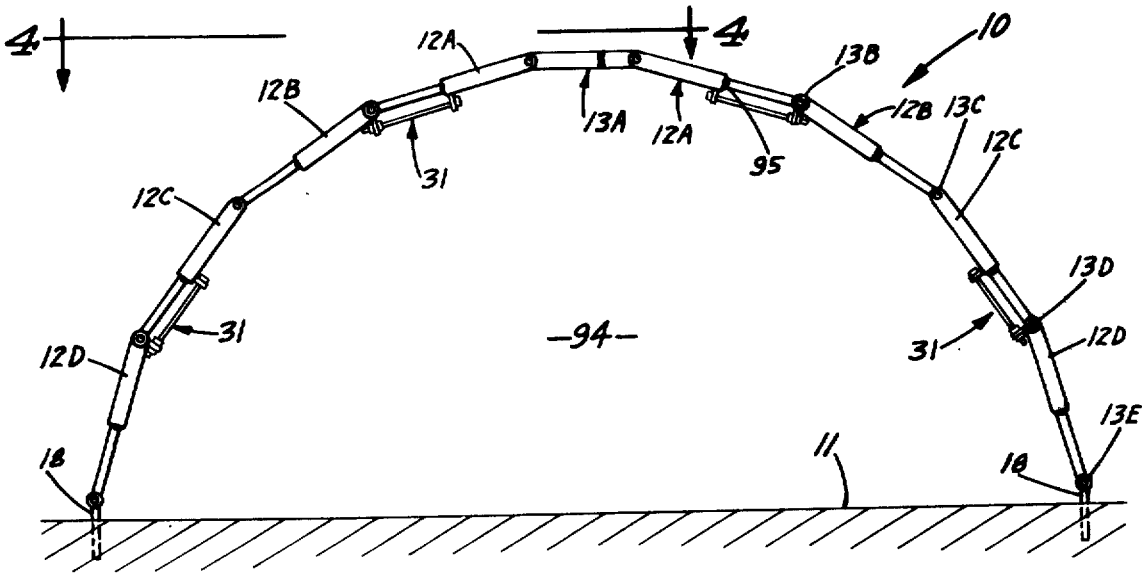
FIG. 3 is a side elevational view of the frame assembly of FIG. 1 in the erected position.

The arcuate shape of the frame assembly is maintained by securing the first and second members of the struts together, such as by weld 95, shown in FIG. 3. After this is done, the fluid under pressure can be released from the system. The fluid lines 44, 46 and 47 can be removed. The framework can then be enclosed with a cover, such as plastic sheet material, concrete or other rigid construction materials. Mechanical structures, such as stops, pins and collars can be used to prevent relative movement of the first and second members of each strut. Also, the struts can be progressively filled with a foamed plastic, such as polyurethane or polystyrene, which will prevent collapse of the erected and expanded struts. The foam plastic can be such that it can be foamed in place within the chamber 27 when the members 21 and 24 shown in FIG. 5 are in the expanded position. Alternatively the resins and foaming agents can be located in or injected into the chambers of the contracted struts. The struts can be extended with the pressure generated by the chemical or foaming reaction of a chemical mixture as plastic resins with foaming agents or chemical blowing agents.

Struts 12 in each row can have varying lengths and thereby change the shape of the final frame assembly. Also, the amount of expansion or longitudinal extension of the extendible struts will determine the final shape of the frame assembly. All of the struts are usable to provide a self-raising frame assembly that is constructed on the ground or on a surface accessible to workers. The construction of the frame assembly is done without supporting framework and with a minimum of time, parts and labor.

The extendible struts 48 and 71 can be used to erect the frame assembly 10. These struts utilize the biasing force of the compression springs 56 and 82, respectively, to expand or extend the struts. The lock pins associated with these struts are removed, whereby the struts will expand and erect the frame assembly. Pins 69 and 83, as shown in FIGS. 6 and 7, can be removed by use of cords or other mechanical structures sufficient to apply a force on the pins. The cords can be interlinked so that the expansion of the center rows of struts will release the pins from the intermediate struts, thereby progressively raising the framework from the surface 11. The frame assembly will be maintained in its erected position by the biasing force of the expansion springs. Additional locking structure, as welds, stop pins and the like, can be utilized to fix the extended positions of the struts. Also, the struts can be designed so that the expansion springs can be removed and reused in subsequent frame assemblies.

Referring to FIGS. 8 to 11, there is shown a frame assembly indicated generally at 100 for enclosing a circular surface 101. When frame assembly 100 is in its raised or erected position, it forms a dome-like framework over surface 101. Surface 101 is surrounded by an annular ring or foundation 102. Located around the surface adjacent foundation 102 are anchors 103 embedded in the floor forming surface 101. Anchors 103 can be secured to foundation 102 or be part of foundation 102.

Figure 8:
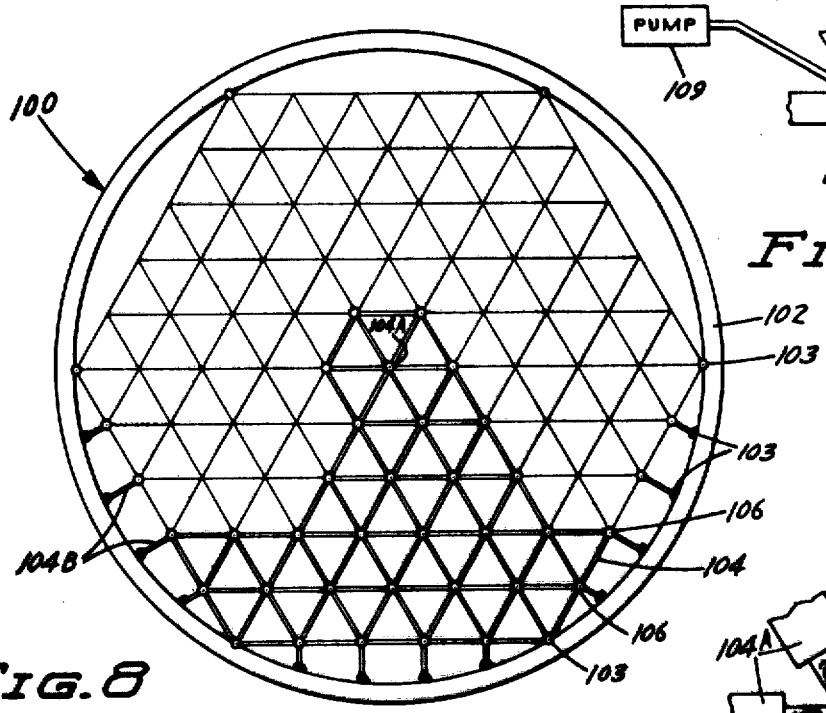
FIG. 8 is a diagrammatic plan view of a dome shaped frame assembly of the invention.
Figure 11:
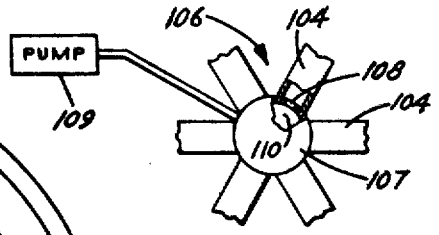
FIG. 11 is a top plan view of the strut means secured to a connector of the frame assembly.

Frame assembly 100 comprises a plurality of triangularly arranged extendible members or struts 104. Each strut 104 has ends connected to connectors or hubs 106 to form an interconnected network, as shown in FIG. 8. The outermost or outer peripheral struts 104B can be rigid members or links of varying lengths that are pivotally connected to the foundation or anchors adjacent the foundation.

Connector 106 comprises a cylindrical housing 107 enclosing a chamber 110. The ends of cylinder struts 104 are secured to circumferential spaced portions of the side wall of housing 107. Passages 108 in side wall 107 provide communication between the chamber and the insides of struts. Air is supplied to the chamber with a pump 109 or any other source of air under pressure.

Figure 12:
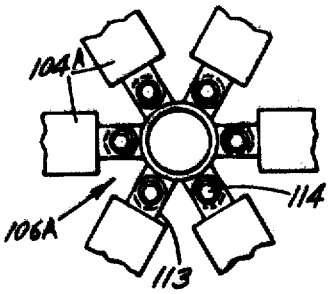
FIG. 12 is a top plan view of a modified connector attached to strut means of the frame assembly.

An example of a modification of the connector is shown in FIG. 12 and identified at 106A. Connector 106A has a cylindrical body 111. A plurality of pairs of outwardly directed ears 112 are secured to the outer side of body 111. Connector 106A has six pairs of ears 112 eqaully spaced around the outer circumferential face of the body 111. Each ear of each pair of ears is spaced from the other a distance to receive a rib or projection 113 extended from the base or end of the adjacent extendible strut 104A. Bolts 114 pivotally connect the projection to the ears whereby the struts can pivot about axes generally transverse to the longitudinal axis of the struts.

The extendible struts 104 have the same structures as the struts shown in FIGS. 5, 6 and 7. Each strut has a first member movably located relative to a second member. A limit stop is used to limit the expanded position of the members. The strut can be expanded in response to fluid under pressure or springs and held in an expanded position in a manner as described with regard to struts 12A, 48 and 71 in FIGS. 5, 6 and 7. The expandable struts can have different lengths to provide for different types of contours of the erected frame assembly.

Figure 9:
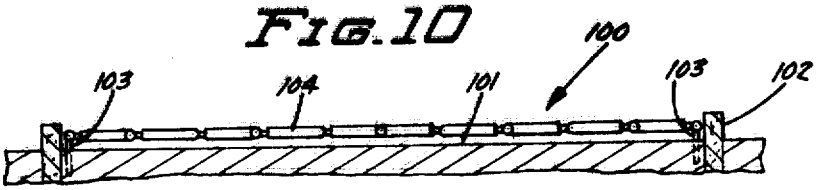
FIG. 9 is a sectional view taken along line 9—9 of FIG. 8 showing the frame assembly in its initial or ground position.

The fabrication and erection of frame assembly 100 is substantially the same as the frame assembly 10 shown in FIGS. 1 to 4. Initially the area to be covered by the frame assembly is laid out and surrounded by the foundation 102. The connectors 106 are laid out on the surface 101 in a generally triangular pattern. The struts 104 are secured to the connectors 106 while they are in their contracted positions. This is done in the ground level or horizontal position, as shown in FIG. 9. The outer peripheral struts are connected adjacent the foundation to the anchors 103.

Figure 10:
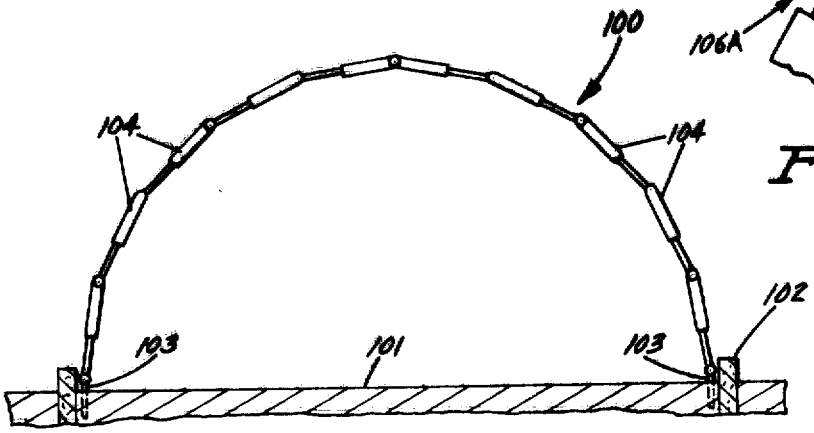
FIG. 10 is a sectional view similar to FIG. 9 showing the frame assembly in the erected position.

The constructed frame assembly is then erected by expanding the struts 104 to form an arcuate or dome-shaped frame assembly, as shown in FIG. 10. All of the struts 106 are expanded together as they are in fluid communication with each other through connector housings 107. Pump 109 is operable to supply air to one of the housings. This air will expand all the struts 106 to erect the frame assembly. As the frame assembly is elevated, the connectors 107 and struts 104 are subjected to bending forces which act to bias the frame assembly in a downward direction. The biasing force due to the flexing of the connectors 107 and struts 104 acts against the force raising the frame assembly to control the curvature of the erected frame assembly. The struts 104 can be expanded in response to a fluid under pressure, as air or water, in a manner as shown in FIG. 1, by selectively closing some of passages 108. Alternatively, springs or similar biasing members can be used to expand the struts. The struts can be progressively expanded from the center connector 104A whereby the frame assembly 100 will sequentially raise as the struts are progressively elongated as a function of the distance from the center of the frame assembly. The struts 104 will continue to expand until the limit stop associated with each strut determines the full length of the expanded strut. The struts may then be secured together to form rigid struts for the frame assembly 100.

Frame assembly 100 is assembled on the surface 101 and is self-lifting in response to expansion forces on the struts. This eliminates the necessity of separate rigging and lifting structures as well as temporary scaffolding.

The embodiments of the invention in which an exclusive property or privilege is claimed are defined as follows:

1. A frame assembly comprising: a plurality of elongated extended first means arranged over part of a surface, each extended first means having opposite ends and a first member and a second member movable relative to the first member, means for holding the first member and second member of the first means in a fixed elongated relationship relative to each other, anchor means located on said surface connected to each first member of the first means to hold the first member in a stationary location, a plurality of elongated extended second means arranged over said surface, each second means having opposite ends and a first member and a second member movable relative to each other, means for holding the first member and second member of the second means in a fixed elongated relationship relative to each other, first connector means coupling adjacent ends of the extended second means to provide a network of extended second means and first connector means, and second connector means coupling the second members of the first means to part of the second means whereby the first and second means are interconnected to form the frame assembly over said surfaces, said first member of each extended means is an elongated first cylinder and the second member of each extended means is an elongated second cylinder mounted in telescopic relation with the first cylinder.

2. The frame assembly of claim 1 including: biasing means cooperating with the first cylinder and the second cylinder to hold the cylinders in their extended positions.

3. The frame assembly of claim 2 wherein: the biasing means is a spring.

4. The frame assembly of claim 2 wherein: the biasing means is located within the first cylinder and second cylinder.

5. The frame assembly of claim 1 wherein: the means for holding the first member and second member of each extended means in a fixed elongated relationship relative to each other is located within the first cylinder and the second cylinder.

6. A frame assembly comprising: a plurality of longitudinally extended means arranged over a surface, each extended means having a first linear member and a second linear member generally longitudinally aligned with each other, means for holding the first linear member and second linear member in a first longitudinal relationship relative to each other, connector means coupling the extended means to provide a network of extended means and connector means, and anchor means for holding the extended means at the outer peripheral edge of the frame assembly in a stationary location, said first member and second member of each extended means having a common chamber, and expanded foam plastic material located in said chamber.

7. A frame assembly comprising: a plurality of longitudinally extended first means arranged over a part of a surface, each extended first means having opposite ends and a first linear member and a second linear member generally longitudinally aligned with each other, means for holding the first linear member and second linear member of the first means in a fixed elongated longitudinal relationship relative to each other, anchor means located around said surface connected to one of the linear members of the first means, a plurality of longitudinally extended second means arranged over said surface, each second means having opposite ends and a first linear member and a second linear member generally longitudinally aligned with each other, means for holding the first and second members of the second means in a fixed elongated relationship relative to each other, first connector means coupling adjacent ends of the extended second means to provide a network of extended second means and first connector means, and second connector means coupling one of the members of the first means to part of the second means whereby the first and second means are interconnected to form the frame assembly over said surface, said first member of the first and second means is an elongated first cylinder and the second member of the first and second means is an elongated second cylinder mounted in telescopic relation with the first cylinder.

8. The frame assembly of claim 7 including: biasing means cooperating with the first cylinder and the second cylinder to hold the cylinders in their extended positions.

9. The frame assembly of claim 8 wherein: the biasing means is a spring.

10. The frame assembly of claim 8 wherein: the biasing means is located within the first cylinder and second cylinder.

11. The frame assembly of claim 7 wherein: the means for holding the first member and second member of the first and second means in a fixed longitudinal relationship relative to each other is located within the first cylinder and the second cylinder.

12. A frame assembly comprising: a plurality of longitudinally extended first means arranged over a part of a surface, each extended first means having opposite ends and a first linear member and a second linear member generally longitudinally aligned with each other, means for holding the first linear member and second linear member of the first means in a fixed elongated longitudinal relationship relative to each other, anchor means located around said surface connected to one of the linear members of the first means, a plurality of longitudinally extended second means arranged over said surface, each second means having opposite ends and a first linear member and a second linear member generally longitudinally aligned with each other, means for holding the first and second members of the second means in a fixed elongated relationship relative to each other, first connector means coupling adjacent ends of the extended second means to provide a network of extended second means and first connector means, and second connector means coupling one of the members of the first means to part of the second means whereby the first and second means are interconnected to form the frame assembly over said surface, said first member and second member of the first and second means having a common chamber, and expanded foam plastic material located in said chamber.

13. A frame assembly comprising: a plurality of elongated extended first means arranged over part of a surface, each extended first means having opposite ends and a first member having a longitudinal axis and a second member having a longitudinal axis, said first and second members being aligned with each other along the longitudinal axes thereof and movable relative to each other along their longitudinal axes to a longitudinally extended position, means for holding the first member and second member of the first means in the longitudinal extended position thereof, anchor means located on said surface connected to each first member of the first means to hold the first member in a stationary location, a plurality of elongated extended second means arranged over said surface, each second means having opposite ends and a first member having a longitudinal axis and a second member having a longitudinal axis, said first and second members of the second means being aligned with each other along the longitudinal axes thereof and movable relative to each other along their longitudinal axes to a longitudinal extended position, means for holding the first member and second member of the second means in the longitudinal extended position thereof, first connector means coupling adjacent ends of the extended second means to provide a network of extended second mean and first connector means, and second connector means coupling the second members of the first means to part of the second means whereby the first and second means are interconnected to form the frame assembly over said surfaces.

14. The frame assembly of claim 13 wherein: the first member of each of the first means and second means is an elongated first cylinder and the second member of each of the first and second means is an elongated cylindrical means mounted in telescopic relation with the first cylinder.

15. The frame assembly of claim 14 including: biasing means cooperating with the first cylinder and the cylindrical means to hold the first member and second member in the extended position.

16. The frame assembly of claim 15 wherein: the biasing means is a spring.

17. The frame assembly of claim 15 wherein: the biasing means is located within the first cylinder.

18. The frame assembly of claim 14 wherein: the means for holding the first member and second member of each of the first and second means in the extended position is located within the first cylinder.

19. The frame assembly of claim 13 wherein: the first and second connector means include elongated rigid members.

20. The frame assembly of claim 13 wherein: the first and second connector means include cylindrical members.

21. The frame assembly of claim 20 including: means to connect the first and second means to the cylindrical members.

22. The frame assembly of claim 13 wherein: the first member and second member of each of the first and second means has a common chamber, and an expanded foam plastic material located in said chamber.

23. The frame assembly of claim 13 including: a plurality of elongated extended third means arranged over said surface, each third means having opposite ends and a first member having a longitudinal axis and a second member having a longitudinal axis, said first and second members of the third means being aligned with each other along the longitudinal axes thereof and movable relative to each other along their longitudinal axes to a longitudinal extended position, means for holding the first and second members of the third means in a longitudinal extended position thereof, said third means being connected to the first connector means.

24. The frame assembly of claim 23 including: third connector means coupling adjacent ends of the third means whereby the second and third means are interconnected.

* * * * *